US011699866B2

(12) United States Patent
Burris et al.

(10) Patent No.: US 11,699,866 B2
(45) Date of Patent: Jul. 11, 2023

(54) COAXIAL CABLE CONNECTOR ASSEMBLIES WITH CURABLE ADHESIVES AND METHODS FOR USING THE SAME

(71) Applicant: Corning Optical Communications RF LLC, Glendale, AZ (US)

(72) Inventors: Donald Andrew Burris, Peoria, AZ (US); David Jeffrey Malouf, Surprise, AZ (US)

(73) Assignee: Corning Optical Communications RF LLC, Glendale, AZ (US)

( * ) Notice: Subject to any disclaimer, the term of this patent is extended or adjusted under 35 U.S.C. 154(b) by 0 days.

(21) Appl. No.: 17/372,867

(22) Filed: Jul. 12, 2021

(65) Prior Publication Data

US 2022/0037811 A1 Feb. 3, 2022

Related U.S. Application Data

(60) Provisional application No. 63/059,639, filed on Jul. 31, 2020.

(51) Int. Cl.

| | |
|---|---|
| ***H01R 9/05*** | (2006.01) |
| ***H01R 24/38*** | (2011.01) |
| ***H01R 43/00*** | (2006.01) |
| ***H01R 103/00*** | (2006.01) |
| ***H01R 13/622*** | (2006.01) |

(52) U.S. Cl.

CPC ..... *H01R 9/05* (2013.01); *H01R 13/622* (2013.01); *H01R 24/38* (2013.01); *H01R 43/00* (2013.01); *H01R 2103/00* (2013.01)

(58) Field of Classification Search

CPC ..... H01R 13/622; H01R 24/38; H01R 43/00; H01R 2103/00; Y10S 439/936

See application file for complete search history.

(56) References Cited

U.S. PATENT DOCUMENTS 5,395,269 A * 3/1995 Koblitz ..... C09J 4/06 174/541

7,331,820 B2 * 2/2008 Burris ..... H01R 9/05 439/275

FOREIGN PATENT DOCUMENTS

CN 104901052 B 7/2018

* cited by examiner

*Primary Examiner* — Briggitte R. Hammond

(74) *Attorney, Agent, or Firm* — Tamika A. Crawl-Bey

(57) ABSTRACT

A method for coupling a coaxial cable to a coaxial cable connector assembly includes inserting a coaxial cable into a cable channel of a rear body of a coaxial cable connector assembly, where the coaxial cable connector assembly includes an adhesive reservoir positioned at least partially within the cable channel of the rear body, the adhesive reservoir comprising an adhesive and an adhesive reservoir seal material that at least partially encapsulates the adhesive, inserting at least a portion of the coaxial cable into the adhesive reservoir, and exposing the adhesive to electromagnetic energy thereby curing the adhesive, by at least one of directing electromagnetic energy from an energy source on the adhesive, and removing an outer jacket from an outer wall of the rear body.

18 Claims, 6 Drawing Sheets

COAXIAL CABLE CONNECTOR ASSEMBLIES WITH CURABLE ADHESIVES AND METHODS FOR USING THE SAME

CROSS-REFERENCE TO RELATED APPLICATION

This application claims the benefit of priority under 35 U.S.C. § 119 to U.S. Provisional Application Ser. No. 63/059,639, filed Jul. 31, 2020, the content of which is relied upon and incorporated herein by reference in its entirety.

BACKGROUND

The present disclosure relates to coaxial cable connector assemblies, and more particularly to coaxial cable connector assemblies with curable adhesives.

Coaxial cable connector assemblies, such as F-type connectors, are conventionally used to connect a coaxial cable to a device, such as a television or the like. Coaxial cables generally include an inner conductor, and an outer conductor extending around the inner conductor. In some configurations, signals are transmitted through the inner conductor, and the outer conductor may be maintained at earth potential.

Conventional cable connector assemblies are coupled to coaxial cables, and generally connect the inner conductor and the outer conductor of the coaxial cable to a receiving port of the receiving device.

BRIEF SUMMARY

In some instances, it may be difficult for a user, such as an installation technician, to couple the coaxial cable to the coaxial cable connector assembly. For example, some conventional coaxial cable connector assemblies may be coupled to a coaxial cable through the deformation of components of the coaxial cable connector assembly. However, it may require significant force to deform components of the coaxial cable connector assemblies and may require the use of cumbersome tools. Accordingly, a need exists for coaxial cable connector assemblies that simplify the installation of a coaxial cable to the coaxial cable connector assembly.

In a first aspect A1, a method for coupling a coaxial cable to a coaxial cable connector assembly includes inserting a coaxial cable into a cable channel of a rear body of a coaxial cable connector assembly, the coaxial cable including an inner conductor, a dielectric material surrounding the inner conductor, an outer conductor surrounding the dielectric material, and an outer cover surrounding the outer conductor, and where the coaxial cable connector assembly includes an adhesive reservoir positioned at least partially within the cable channel of the rear body, the adhesive reservoir including an adhesive and an adhesive reservoir seal material that at least partially encapsulates the adhesive, inserting at least a portion of the coaxial cable into the adhesive reservoir, and exposing the adhesive to electromagnetic energy thereby curing the adhesive, by at least one of (1) directing electromagnetic energy from an energy source on the adhesive, and (2) removing an outer jacket from an outer wall of the rear body.

In a second aspect A2, the present disclosure provides the method of aspect A1, where exposing the adhesive to electromagnetic energy includes directing electromagnetic energy from the energy source on the adhesive.

In a third aspect A3 the present disclosure provides the method of aspect A2, where directing electromagnetic energy from the energy source includes directing ultraviolet electromagnetic energy.

In a fourth aspect A4, the present disclosure provides the method of aspects A2 or A3, where directing electromagnetic energy from the energy source includes directing electromagnetic energy having a wavelength between about 100 nanometers and about 280 nanometers.

In a fifth aspect A5, the present disclosure provides the method of aspect A1, where exposing the adhesive to electromagnetic energy includes removing the outer jacket from the outer wall of the rear body.

In a sixth aspect A6, the present disclosure provides the method of any of aspects A1-A5, where exposing the adhesive to electromagnetic energy includes transmitting electromagnetic energy through the outer wall of the rear body.

In a seventh aspect A7, the present disclosure provides the method of any of aspects A1-A6, further including engaging the inner conductor of the coaxial cable with a tubular post positioned within the cable channel of the rear body.

In an eighth aspect A8, the present disclosure provides the method of any of aspects A1-A7, where inserting at least a portion of the coaxial cable into the adhesive reservoir includes inserting at least a portion of the coaxial cable through the adhesive reservoir seal material.

In a ninth aspect A9, the present disclosure provides a coaxial cable connector assembly includes a coupler defining an inner channel extending through the coupler between a front portion of the coupler and a rear portion of the coupler positioned opposite the front portion, a rear body, positioned rearward of the coupler, including an outer wall defining a cable channel extending through the rear body, and structurally configured to receive a coaxial cable, and an adhesive reservoir positioned at least partially within the cable channel of the rear body, the adhesive reservoir including an adhesive that is structurally configured to cure upon application of ultraviolet electromagnetic energy.

In a tenth aspect A10, the present disclosure provides the coaxial cable connector assembly of aspect A9, where the adhesive is structurally configured to cure upon the application of ultraviolet electromagnetic energy having a wavelength between about 100 nanometers and about 280 nanometers.

In an eleventh aspect A11, the present disclosure provides the coaxial cable connector assembly of aspects A9 or A10, where the adhesive reservoir is an annular reservoir.

In a twelfth aspect A12, the present disclosure provides the coaxial cable connector assembly of any of aspects A9-A11, further including a tubular post positioned at least partially within the cable channel of the rear body.

In a thirteenth aspect A13, the present disclosure provides the coaxial cable connector assembly of any of aspects A9-A12, where the outer wall of the rear body is structurally configured to transmit ultraviolet electromagnetic radiation.

In a fourteenth aspect A14, the present disclosure provides the coaxial cable connector assembly of any of aspects A9-A13, where the outer wall of the rear body is structurally configured to transmit electromagnetic radiation having a wavelength between about 100 nanometers and about 280 nanometers and restricts transmission of electromagnetic radiation having other wavelengths.

In a fifteenth aspect A15, the present disclosure provides a coaxial cable connector assembly includes a coupler defining an inner channel extending through the coupler between a front portion of the coupler and a rear portion of the coupler positioned opposite the front portion, a rear body, positioned rearward of the coupler, including an outer wall defining a cable channel extending through the rear body, and structurally configured to receive a coaxial cable, an outer jacket positioned outwardly from and surrounding the outer wall, where the outer jacket is selectively removable from the outer wall, and an adhesive reservoir positioned at least partially within the cable channel of the rear body, the adhesive reservoir including an adhesive that is structurally configured to cure upon application of electromagnetic energy.

In a sixteenth aspect A16, the present disclosure provides the coaxial cable connector assembly of aspect A15, where the coupler includes a thread positioned at the front portion of the coupler, and where the thread is structurally configured to couple the coaxial cable connector assembly to a port of a device.

In a seventeenth aspect A17, the present disclosure provides the coaxial cable connector assembly of aspects A15 or A16, where the adhesive reservoir is an annular reservoir.

In an eighteenth aspect A18, the present disclosure provides the coaxial cable connector assembly of any of aspects A15-A17, further including a tubular post positioned at least partially within the cable channel of the rear body.

In a nineteenth aspect A19, the present disclosure provides the coaxial cable connector assembly of any of aspects A15-A18, where the outer wall of the rear body is structurally configured to transmit electromagnetic radiation having a wavelength within the visible spectrum.

In a twentieth aspect A20, the present disclosure provides the coaxial cable connector assembly of any of aspects A15-A19, where the outer jacket is structurally configured to restrict transmission of electromagnetic energy within the visible spectrum.

Additional features and advantages of the technology disclosed in this disclosure will be set forth in the detailed description which follows, and in part will be readily apparent to those skilled in the art from the description or recognized by practicing the technology as described in this disclosure, including the detailed description which follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

Embodiments described herein are generally directed to coaxial cable connector assemblies including curable adhesives that couple a rear body of the coaxial cable connector assembly to a coaxial cable. In some embodiments, the curable adhesive may be cured by the application of electromagnetic energy that is outside of the visible spectrum, for example, ultraviolet light. In some embodiments, the curable adhesive may be cured by the application of electromagnetic energy that is within the visible spectrum (e.g., ambient light), and the coaxial cable may include a removable outer jacket that selectively exposes the curable adhesive to electromagnetic energy. These and other embodiments of coaxial cable connector assemblies are disclosed in greater detail herein with reference to the appended figures.

Figure 1:
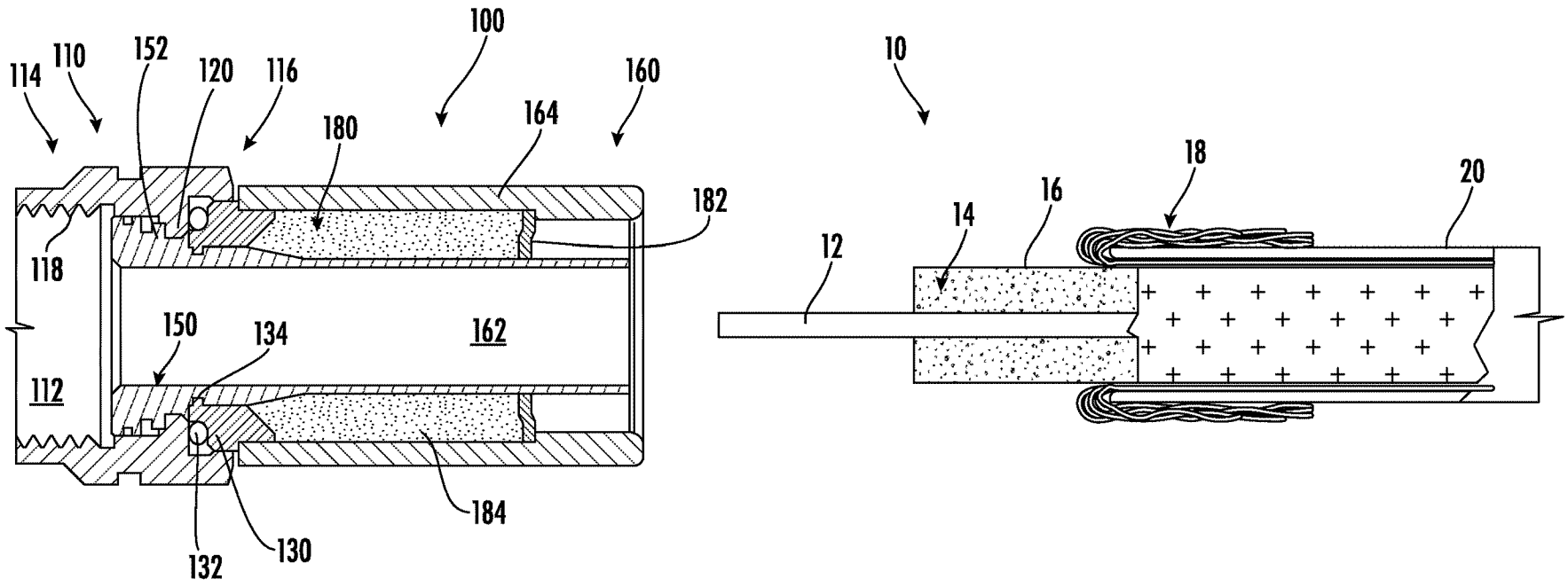
FIG. 1 schematically depicts a section view of a coaxial cable and coaxial cable connector assembly including a curable adhesive, according to one or more embodiments shown and described herein.

Now referring to FIG. 1, a section view of the coaxial cable connector assembly 100 and a coaxial cable 10 are schematically depicted. The coaxial cable 10 generally includes an inner conductor 12 surrounded by a dielectric material 14. In embodiments, electrical signals may be passed through the inner conductor 12, such as to a device connected to the coaxial cable 10, and the inner conductor 12 may be formed of a conductive material, such as copper, aluminum, or the like. The dielectric material 14 generally electrically insulates the inner conductor 12, and may include a polymer or the like. In some embodiments, the dielectric material 14 is generally elastic and may allow the dielectric material 14 to elastically deform under force, thereby allowing the coaxial cable 10 to bend.

In embodiments, the coaxial cable 10 further includes an outer conductor 16 surrounding the dielectric material 14. In some configurations, the outer conductor 16 may be maintained at a ground potential while electrical signals are transmitted through the inner conductor 12. The outer conductor 16 may be formed of a conductive material, such as aluminum foil, copper foil, or the like. In some embodiments, the coaxial cable 10 further includes an outer braid 18 positioned outwardly from and engaged with the outer conductor 16. In embodiments, the outer braid 18 may be formed of a conductive material, such as braided copper wire, braided aluminum wire or the like. In embodiments, the outer braid 18 may assist in shielding the inner conductor 12 of the coaxial cable 10.

The coaxial cable 10, in embodiments, further includes an outer cover 20 surrounding at least a portion of the outer conductor 16 and/or the outer braid 18. The outer cover 20 may be formed of a polymer or the like and may generally protect the coaxial cable 10 from environmental elements, such as moisture.

The coaxial cable connector assembly 100 generally includes a coupler 110 and a rear body 160 positioned rearward of the coupler 110. In embodiments, the coupler 110 is rotatably engaged with the rear body 160, such that the coupler 110 may rotate about the rear body 160.

In embodiments, the coupler 110 defines an inner channel 112 extending between a front portion 114 of the coupler 110 and a rear portion 116 of the coupler 110 positioned opposite the front portion 114. In embodiments, the coupler 110 defines a thread 118 at the front portion 114 of the coupler 110. The thread 118, in embodiments, is structurally configured to engage a corresponding thread of a port of a device, such as a television, a cable box, or the like to couple the coaxial cable connector assembly 100 to the port of the device. The coupler 110 may be formed of a material suitable to conduct electricity, such as copper, brass, aluminum, or the like, and in embodiments, the coupler 110 is electrically coupled to the outer conductor 16 and/or the outer braid 18 of the coaxial cable 10, as described in greater detail herein.

In embodiments, the rear body 160 includes an outer wall 164 that defines a cable channel 162 extending through the rear body 160. The cable channel 162 is structurally configured to receive the coaxial cable 10 as the coaxial cable 10 is inserted within the coaxial cable connector assembly 100. The rear body 160 can be coupled to the coaxial cable 10, as described in greater detail herein.

In some embodiments, the outer wall 164 is formed of a material that permits electromagnetic radiation to pass through the outer wall 164. In some embodiments, the outer wall 164 is formed of a material that selectively permits electromagnetic radiation to pass through the outer wall 164. For example, in some embodiments, the outer wall 164 permits the transmission of ultraviolet radiation through the outer wall 164, for example and without limitation, vacuum ultraviolet (VUV) and/or ultraviolet C (UVC) radiation, or the like. In some embodiments, the outer wall 164 may permit the transmission of ultraviolet radiation, while restricting the transmission of other wavelengths of radiation. In some embodiments, the outer wall 164 may permit the transmission of electromagnetic radiation having a wavelength between about 100 nanometers and about 280 nanometers, inclusive of the endpoints. In some embodiments, the outer wall 164 may permit the transmission of electromagnetic radiation having a wavelength between about 100 nanometers and about 280 nanometers, inclusive of the endpoints, while restricting the transmission of other wavelengths of radiation. In embodiments, the outer wall 164 may be formed of any suitable material for permitting or selectively permitting selected wavelengths of radiation, for example and without limitation, one or more resins such as cyclic olefin copolymers and/or the like.

In some embodiments, the coaxial cable connector assembly 100 further includes a tubular post 150 positioned at least partially within the cable channel 162 of the rear body 160. In embodiments, the tubular post 150 may be inserted between the outer conductor 16 of the coaxial cable 10 and the dielectric material 14, or between the outer braid 18 and the outer conductor 16 of the coaxial cable 10. Through contact with the outer conductor 16 and/or the outer braid 18 of the coaxial cable 10, the tubular post 150 may be electrically coupled to the outer braid 18 and/or the outer conductor 16 of the coaxial cable 10.

In some embodiments, the rear body 160 is coupled to the coupler 110 by the tubular post 150. For example, in some embodiments, the tubular post 150 includes a forward flange 152 that is engaged with a retention notch 120 of the coupler 110 that restrains axial motion of the tubular post 150 with respect to the coupler 110. In some embodiments, the tubular post 150 is electrically coupled to the coupler 110, for example, through engagement between the forward flange 152 of the tubular post 150 and the coupler 110.

In some embodiments, the coaxial cable connector assembly 100 includes a retention member 130 engaged with the tubular post 150 and the rear body 160. For example, in some embodiments, the retention member 130 includes a notch feature 134 that is engaged with the tubular post 150 that restricts axial movement of the tubular post 150 with respect to the retention member 130. The retention member 130 may also be coupled to the rear body 160. For example, in some embodiments the retention member 130 may be coupled to the rear body 160 through a structural adhesive, a press-fit connection, or the like, such that the rear body 160 is coupled to the coupler 110 through the tubular post 150 and the retention member 130.

In some embodiments, the coaxial cable connector assembly 100 may further include a sealing member 132 positioned between the coupler 110 and the retention member 130 and/or the rear body 160. The sealing member 132 may include a resilient member, for example, an o-ring or the like, that maintains contact with the coupler 110 and the retention member 130 and/or the rear body 160. The sealing member 132 may restrict environmental elements such as moisture from reaching the cable channel 162 and/or the inner channel 112.

While in the embodiment depicted in FIG. 1, the tubular post 150 is electrically coupled to the outer conductor 16 and/or the outer braid 18 of the coaxial cable 10, in embodiments described herein, the outer conductor 16 and/or the outer braid 18 can be electrically coupled to the coupler 110. For example, in some embodiments, the outer conductor 16 and/or the outer braid 18 may be electrically coupled to the coupler 110 through the tubular post 150. In some embodiments, the outer conductor 16 and/or the outer braid 18 may directly engage the coupler 110 and/or other intermediate components positioned between the outer conductor 16 and/or the outer braid 18 and the coupler 110 to electrically couple the outer conductor 16 and/or the outer braid 18 to the coupler 110.

In embodiments, the coaxial cable connector assembly 100 includes an adhesive reservoir 180 positioned at least partially within the cable channel 162 of the rear body 160. In embodiments in which the coaxial cable connector assembly 100 includes the tubular post 150, the adhesive reservoir 180 may be an annular reservoir formed by the tubular post 150 and the outer wall 164 of the rear body 160.

The adhesive reservoir 180 generally includes an adhesive reservoir seal material 182 that encapsulates an adhesive 184. In embodiments, the adhesive reservoir seal material 182 of the adhesive reservoir 180 may include any suitable movable, rupturable, tearable, and/or frangible material structurally configured to permit insertion of at least a portion of the coaxial cable 10 into the adhesive reservoir 180 upon the application of a force exceeding a predetermined threshold.

Figure 2:
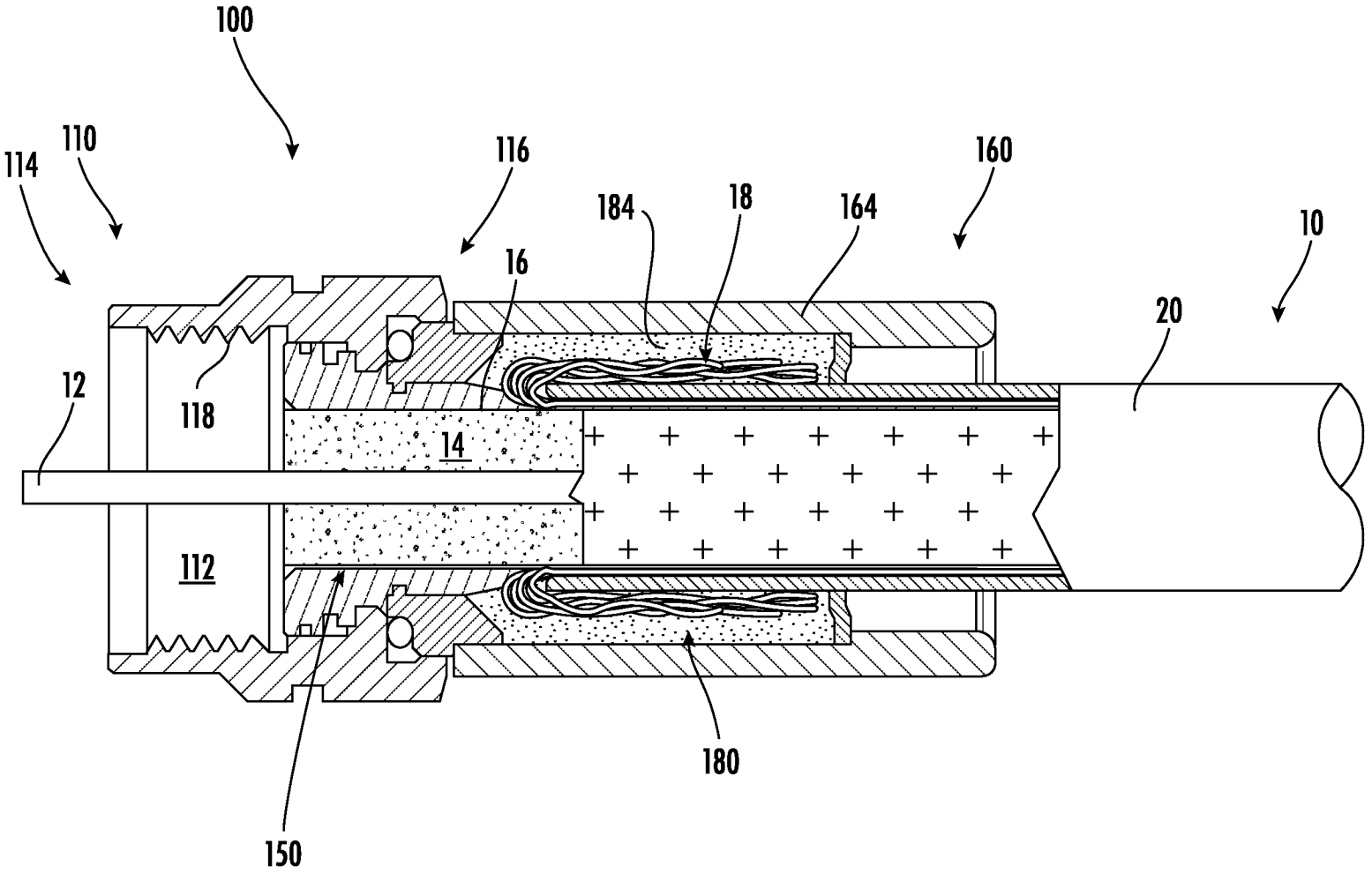
FIG. 2 schematically depicts a section view of the coaxial cable connector assembly of FIG. 1 with the coaxial cable inserted at least partially within the coaxial cable connector assembly, according to one or more embodiments shown and described herein.

Referring collectively to FIGS. 1 and 2, to assemble the coaxial cable 10 to the coaxial cable connector assembly 100, the coaxial cable 10 is inserted into the cable channel 162 of the rear body 160. In embodiments in which the coaxial cable connector assembly 100 includes a tubular post 150, the tubular post 150 may be inserted between the outer conductor 16 and the outer braid 18 or between the outer conductor 16 and the dielectric material 14. As the coaxial cable 10 is inserted axially along the rear body 160, the coaxial cable 10 contacts the adhesive reservoir seal material 182 of the adhesive reservoir 180. For example, in some embodiments, the outer braid 18 may be folded back over the outer cover 20 of the coaxial cable 10, and as the coaxial cable 10 is inserted into the cable channel 162 of the rear body 160, the outer braid 18 may contact the adhesive reservoir seal material 182 of the adhesive reservoir 180.

With the coaxial cable 10 in contact with the adhesive reservoir seal material 182 of the adhesive reservoir 180, further insertion of the coaxial cable 10 into the coaxial cable connector assembly 100 imparts a force on the adhesive reservoir seal material 182 of the adhesive reservoir 180. When the force exceeding a predetermined threshold is applied to the adhesive reservoir 180 (e.g., via the coaxial cable 10), adhesive reservoir seal material 182 of the adhesive reservoir 180 fractures or moves, permitting insertion of at least a portion of the coaxial cable 10 into the adhesive reservoir 180. As the coaxial cable 10 is inserted into the adhesive reservoir 180, the adhesive 184 contacts the coaxial cable 10.

As the coaxial cable 10 is inserted into the coaxial cable connector assembly 100, the outer conductor 16 and/or the outer braid 18 contacts the tubular post 150. As discussed above, contact between the outer conductor 16 and/or the outer braid 18 of the coaxial cable 10 and the tubular post 150, in embodiments, electrically couples the outer conductor 16 and/or the outer braid 18 to the tubular post 150 and/or the coupler 110.

Figure 3:
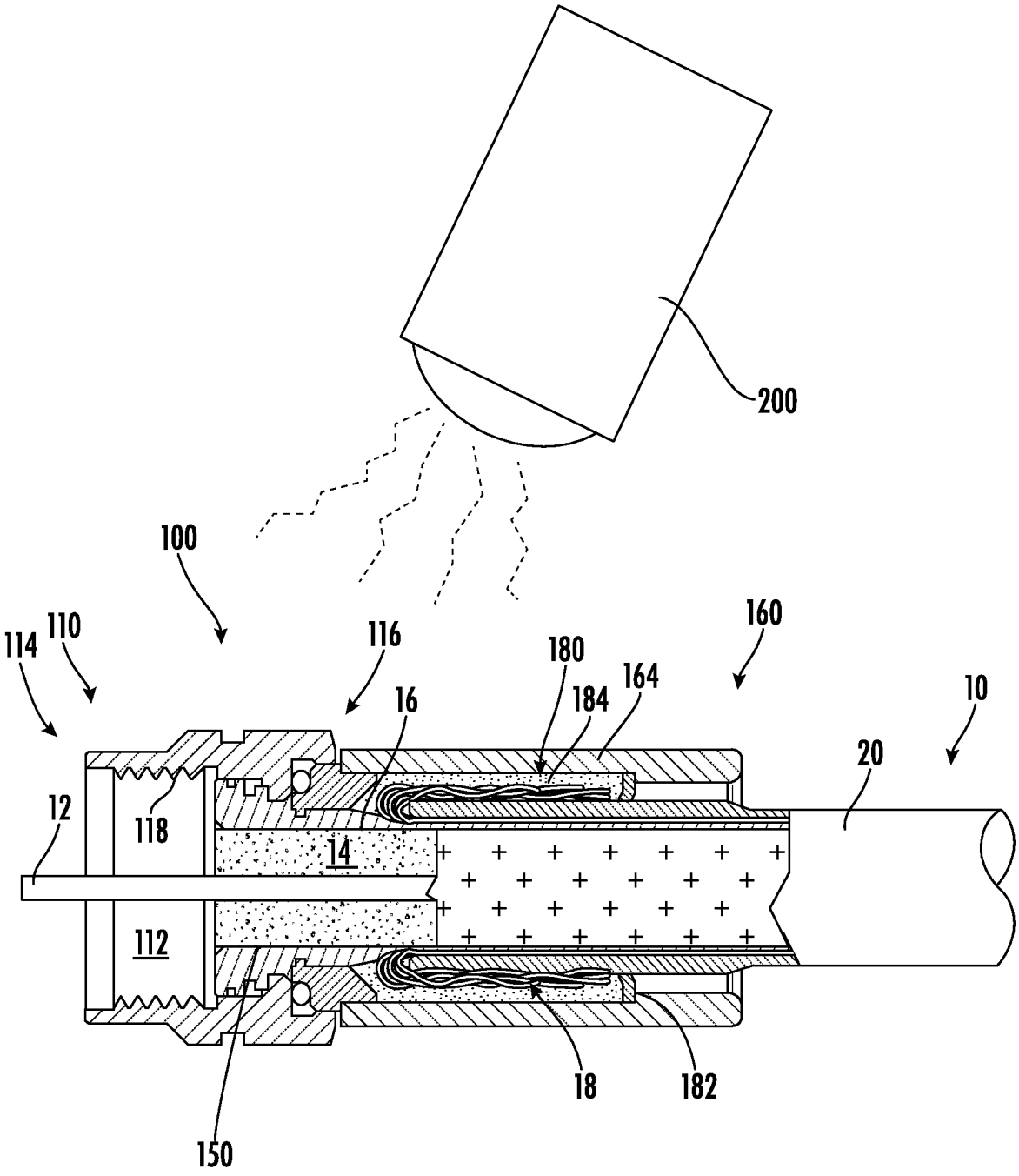
FIG. 3 schematically depicts a section view of the coaxial cable connector assembly of FIG. 1 with an energy source, according to one or more embodiments shown and described herein.

Referring to FIG. 3, in some embodiments, the adhesive 184 may be cured by an energy source 200. In particular, the adhesive 184 may initially be in a fluid or gelatinous state, and may be hardened upon the application of energy. For example, in some embodiments, the adhesive 184 is structurally configured to harden upon the application of electromagnetic radiation emitted by the energy source 200. In some embodiments, the energy source 200 emits electromagnetic radiation having a wavelength within a predetermined range, and the adhesive 184 may be structurally configured to harden upon the application of electromagnetic radiation within the predetermined range. For example, in some embodiments, the energy source 200 may emit ultraviolet radiation. In some embodiments, the energy source 200 may emit VUV and/or UVC radiation. In some embodiments, the energy source 200 may emit electromagnetic radiation having a wavelength between about 100 nanometers and about 280 nanometers, inclusive of the endpoints.

In some embodiments, the adhesive 184 may harden upon the application of ultraviolet radiation. In some embodiments, the adhesive 184 may harden upon the application of ultraviolet radiation, while remaining in a fluid state upon the application of radiation having other wavelengths. In some embodiments, the adhesive 184 may harden upon the application of VUV and/or UVC radiation. In some embodiments, the adhesive 184 may harden upon the application of VUV and/or UVC radiation, while remaining in the fluid or gelatinous state upon the application of radiation in other wavelengths, for example wavelengths in the visible spectrum. In some embodiments, the adhesive 184 may harden upon the application of electromagnetic radiation having a wavelength between about 100 nanometers and about 280 nanometers, inclusive of the endpoints. In some embodiments, the adhesive 184 may harden upon the application of electromagnetic radiation having a wavelength between about 100 nanometers and about 280 nanometers, inclusive of the endpoints, while remaining in a fluid or gelatinous state upon the application of energy having other wavelengths. In some embodiments, the adhesive 184 may be a light cure adhesive, such as a LOCTITE AA series adhesive available from the Henkel Corporation.

As noted above, in some embodiments, the outer wall 164 of the rear body 160 may permit the transmission of ultraviolet radiation, such that energy emitted from the energy source 200 may penetrate the outer wall 164 to reach the adhesive 184.

By curing the adhesive 184 with the energy source 200 to couple the coaxial cable 10 to the coaxial cable connector assembly 100, the coaxial cable 10 can be coupled to the coaxial cable connector assembly 100, without requiring the deformation of one or more components of the coaxial cable connector assembly 100 to crimp or "pinch" the coaxial cable 10. Furthermore, by curing the adhesive 184 with the energy source 200, the adhesive 184 may remain in a fluid or gelatinous state, thereby allowing adjustment of the position of the coaxial cable 10 with respect to the coaxial cable connector assembly 100 before the coaxial cable 10 is coupled to the coaxial cable connector assembly 100.

Figure 4:
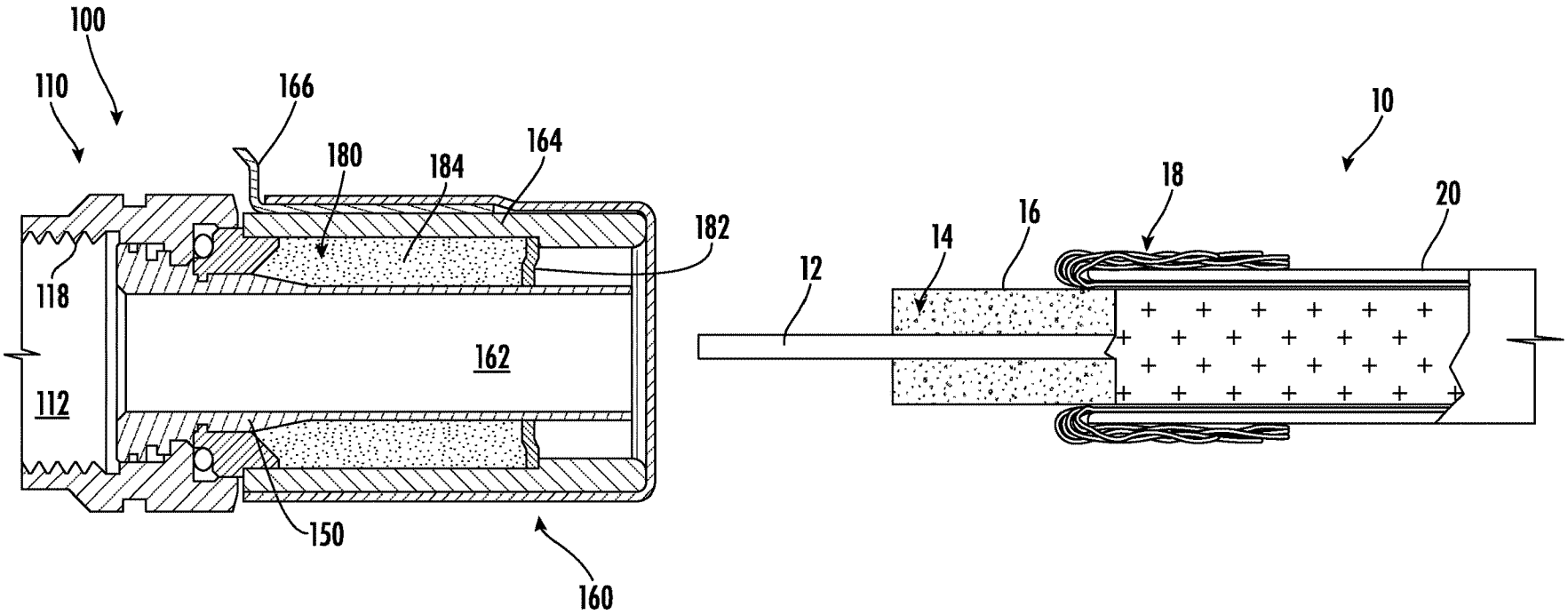
FIG. 4 schematically depicts a section view of a coaxial cable and another coaxial cable connector assembly including a selectively removable outer jacket, according to one or more embodiments shown and described herein.
Figure 5:
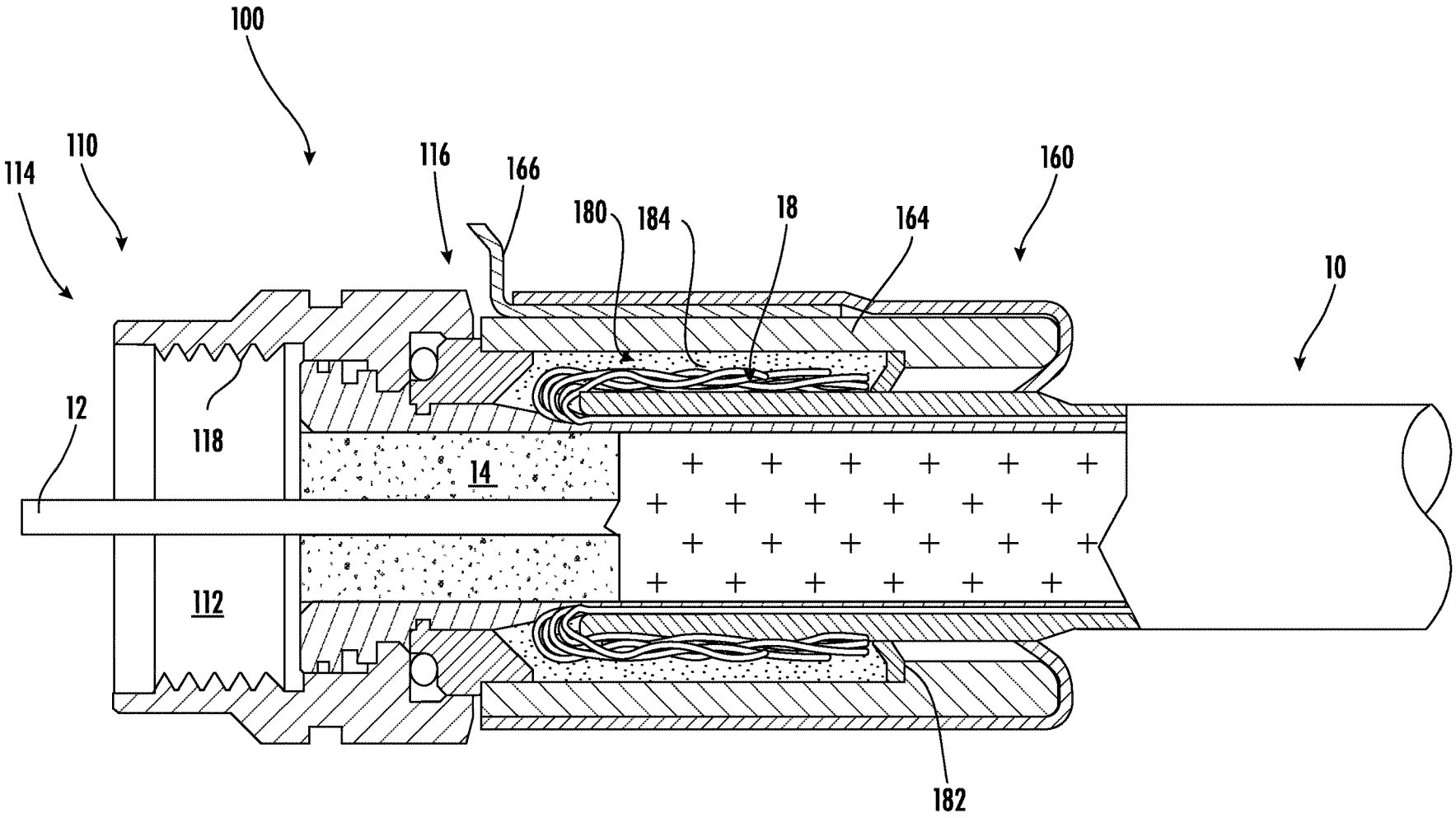
FIG. 5 schematically depicts a section view of the coaxial cable connector assembly of FIG. 4 with the coaxial cable inserted at least partially within the coaxial cable connector assembly, according to one or more embodiments shown and described herein.

Referring to FIGS. 4 and 5, a section view of another coaxial cable connector assembly 100 is depicted. Similar to the embodiment depicted in FIGS. 1-3, in the embodiment depicted in FIGS. 4 and 5, the coaxial cable connector assembly 100 includes the coupler 110 and the rear body 160 including the outer wall 164. However, in the embodiment depicted in FIGS. 4 and 5, the rear body further includes an outer jacket 166 positioned outwardly from outer wall 164. In some embodiments, the outer wall 164 may be configured to transmit electromagnetic energy having wavelengths within the visible spectrum (e.g., between about 380 nanometers and about 700 nanometers), and the outer jacket 166 may restrict the transmission of electromagnetic energy having wavelengths in the visible spectrum. In some embodiments, the outer jacket 166 may include a metal foil, such as gold foil, aluminum foil, or the like.

Figure 6:
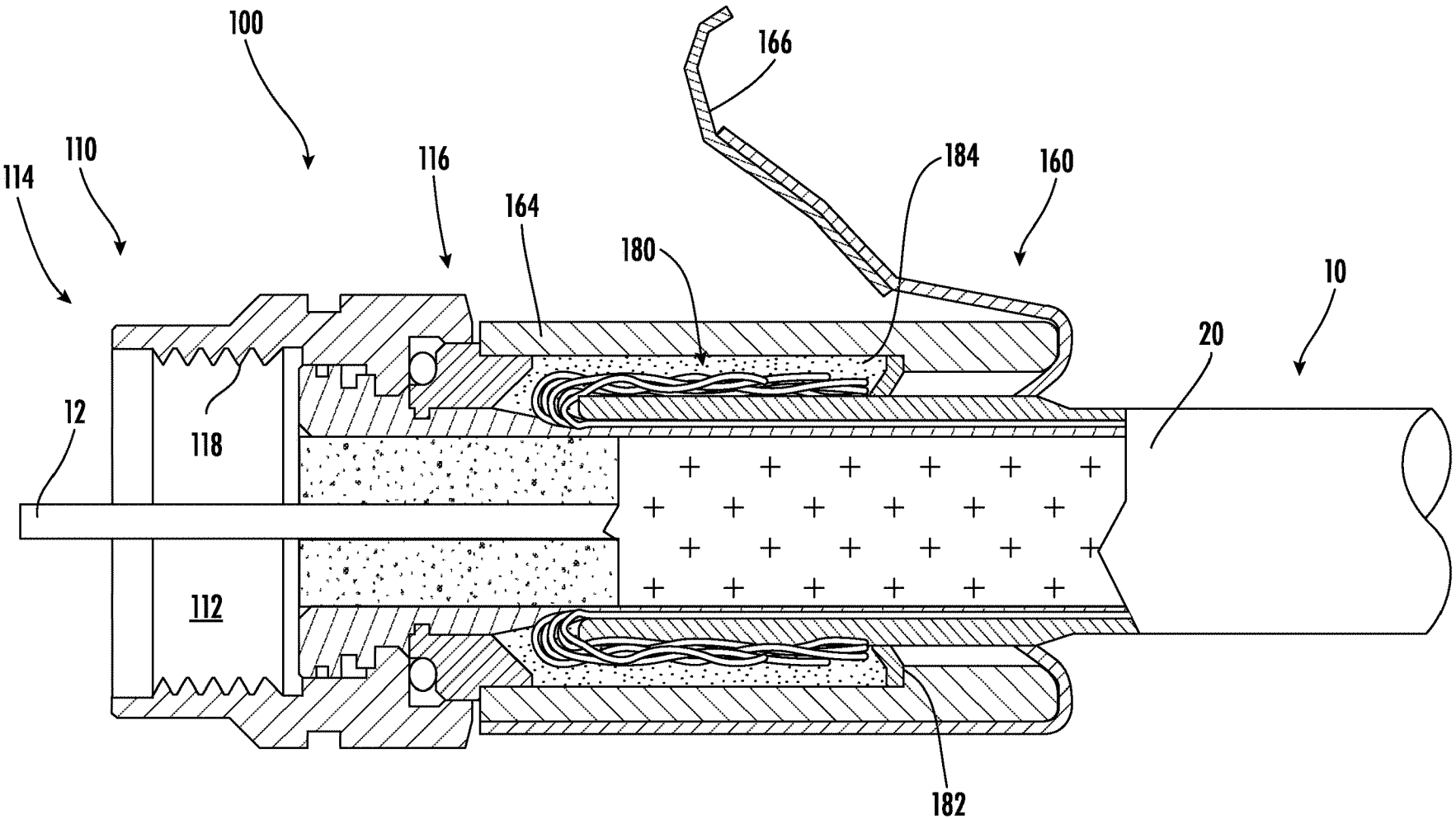
FIG. 6 schematically depicts the coaxial cable connector assembly of FIG. 4 with the removable outer jacket at least partially removed, according to one or more embodiments shown and described herein.

Referring to FIG. 6, in embodiments, the outer jacket 166 is selectively removable from the outer wall 164. For example, the outer jacket 166 may be removed from the outer wall 164, thereby exposing the outer wall 164 to electromagnetic radiation in the visible spectrum (e.g., ambient light). In embodiments, the adhesive 184 may be structurally configured to cure upon the application of electromagnetic energy within the visible spectrum. Accordingly, when the outer jacket 166 is positioned over the outer wall 164, the outer jacket 166 may restrict the transmission of electromagnetic energy (e.g., ambient light) through the outer wall to the adhesive 184, such that the adhesive 184 remains in a fluid or gelatinous state. When the outer jacket 166 is removed from the outer wall 164, electromagnetic energy in the visible spectrum (e.g., ambient light) may be transmitted through the outer wall 164, and may cure the adhesive 184. In this way, the adhesive 184 may be cured to couple the coaxial cable 10 to the coaxial cable connector assembly 100 via exposure to ambient light without the use of an external energy source. By restricting the transmission of electromagnetic energy to the adhesive 184 via the outer jacket 166, the position of the coaxial cable 10 with respect to the coaxial cable connector assembly 100 can be adjusted before the coaxial cable 10 is coupled to the coaxial cable connector assembly 100.

Accordingly, it should now be understood that embodiments described herein are generally directed to coaxial cable connector assemblies including curable adhesives that couple a rear body of the coaxial cable connector assembly to a coaxial cable. In some embodiments, the curable adhesive may be cured by the application of electromagnetic energy that is outside of the visible spectrum, for example, ultraviolet light. In some embodiments, the curable adhesive may be cured by the application of electromagnetic energy that is within the visible spectrum (e.g., ambient light), and the coaxial cable may include a removable outer jacket that selectively exposes the curable adhesive to electromagnetic energy.

Having described the subject matter of the present disclosure in detail and by reference to specific embodiments, it is noted that the various details described in this disclosure should not be taken to imply that these details relate to elements that are essential components of the various embodiments described in this disclosure, even in cases where a particular element is illustrated in each of the drawings that accompany the present description. Rather, the appended claims should be taken as the sole representation of the breadth of the present disclosure and the corresponding scope of the various embodiments described in this disclosure. Further, it should be apparent to those skilled in the art that various modifications and variations can be made to the described embodiments without departing from the spirit and scope of the claimed subject matter. Thus, it is intended that the specification cover the modifications and variations of the various described embodiments provided such modification and variations come within the scope of the appended claims and their equivalents.

It is noted that recitations herein of a component of the present disclosure being "structurally configured" in a particular way, to embody a particular property, or to function in a particular manner, are structural recitations, as opposed to recitations of intended use. More specifically, the references herein to the manner in which a component is "structurally configured" denotes an existing physical condition of the component and, as such, is to be taken as a definite recitation of the structural characteristics of the component.

It is noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

For the purposes of describing and defining the present invention it is noted that the terms "substantially" and "about" are utilized herein to represent the inherent degree of uncertainty that may be attributed to any quantitative comparison, value, measurement, or other representation. The terms "substantially" and "about" are also utilized herein to represent the degree by which a quantitative representation may vary from a stated reference without resulting in a change in the basic function of the subject matter at issue.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A method for coupling a coaxial cable to a coaxial cable connector assembly, the method comprising:

inserting the coaxial cable into a cable channel of a rear body of the coaxial cable connector assembly, the coaxial cable comprising an inner conductor, a dielectric material surrounding the inner conductor, an outer conductor surrounding the dielectric material, and an outer cover surrounding the outer conductor, and wherein the coaxial cable connector assembly comprises an adhesive reservoir positioned at least partially within the cable channel of the rear body, the adhesive reservoir comprising an adhesive and an adhesive reservoir seal material that at least partially encapsulates the adhesive;

inserting at least a portion of the coaxial cable into the adhesive reservoir; and exposing the adhesive to electromagnetic energy thereby curing the adhesive, by at least one of directing electromagnetic energy from an energy source on the adhesive, and removing an outer jacket from an outer wall of the rear body.

2. The method of claim 1, wherein exposing the adhesive to electromagnetic energy comprises directing electromagnetic energy from the energy source on the adhesive.

3. The method of claim 2, wherein directing electromagnetic energy from the energy source comprises directing ultraviolet electromagnetic energy.

4. The method of claim 2, wherein directing electromagnetic energy from the energy source comprises directing electromagnetic energy having a wavelength between about 100 nanometers and about 280 nanometers.

5. The method of claim 1, wherein exposing the adhesive to electromagnetic energy comprises removing the outer jacket from the outer wall of the rear body.

6. The method of claim 2, wherein exposing the adhesive to electromagnetic energy comprises transmitting electromagnetic energy through the outer wall of the rear body.

7. The method of claim 1, further comprising engaging the inner conductor of the coaxial cable with a tubular post positioned within the cable channel of the rear body.

8. The method of claim 1, wherein inserting at least a portion of the coaxial cable into the adhesive reservoir comprises inserting at least a portion of the coaxial cable through the adhesive reservoir seal material.

9. A coaxial cable connector assembly comprising:

a coupler defining an inner channel extending through the coupler between a front portion of the coupler and a rear portion of the coupler positioned opposite the front portion;

a rear body, positioned rearward of the coupler, comprising an outer wall defining a cable channel extending through the rear body, and structurally configured to receive a coaxial cable; and an adhesive reservoir positioned at least partially within the cable channel of the rear body, the adhesive reservoir comprising an adhesive that is structurally configured to cure upon application of ultraviolet electromagnetic energy, wherein the adhesive reservoir is an annular reservoir, and wherein the adhesive is structurally configured to cure upon the application of ultraviolet electromagnetic energy having a wavelength between about 100 nanometers and about 280 nanometers.

10. The coaxial cable connector assembly of claim 9, further comprising a tubular post positioned at least partially within the cable channel of the rear body.

11. The coaxial cable connector assembly of claim 9, wherein the outer wall of the rear body is structurally configured to transmit ultraviolet electromagnetic radiation.

12. The coaxial cable connector assembly of any of claim 9, wherein the outer wall of the rear body is structurally configured to transmit electromagnetic radiation having a wavelength between about 100 nanometers and about 280 nanometers and restricts transmission of electromagnetic radiation having other wavelengths.

13. A coaxial cable connector assembly comprising:

a coupler defining an inner channel extending through the coupler between a front portion of the coupler and a rear portion of the coupler positioned opposite the front portion;

a rear body, positioned rearward of the coupler, comprising an outer wall defining a cable channel extending through the rear body, and structurally configured to receive a coaxial cable;

an outer jacket positioned outwardly from and surrounding the outer wall, wherein the outer jacket is selectively removable from the outer wall; and an adhesive reservoir positioned at least partially within the cable channel of the rear body, the adhesive reservoir comprising an adhesive that is structurally configured to cure upon application of electromagnetic energy, wherein the outer jacket is structurally configured to restrict transmission of electromagnetic energy within a visible spectrum.

14. The coaxial cable connector assembly of claim 13, wherein the coupler comprises a thread positioned at the front portion of the coupler, and wherein the thread is structurally configured to couple the coaxial cable connector assembly to a port of a device.

15. The coaxial cable connector assembly of claim 13, wherein the adhesive reservoir is an annular reservoir.

16. The coaxial cable connector assembly of any of claim 13, further comprising a tubular post positioned at least partially within the cable channel of the rear body.

17. The coaxial cable connector assembly of claim 13, wherein the outer wall of the rear body is structurally configured to transmit electromagnetic radiation having a wavelength within a visible spectrum.

18. A coaxial cable connector assembly comprising:

a coupler defining an inner channel extending through the coupler between a front portion of the coupler and a rear portion of the coupler positioned opposite the front portion;

a rear body, positioned rearward of the coupler, comprising an outer wall defining a cable channel extending through the rear body, and structurally configured to receive a coaxial cable; and an adhesive reservoir positioned at least partially within the cable channel of the rear body, the adhesive reservoir comprising an adhesive that is structurally configured to cure upon application of ultraviolet electromagnetic energy, wherein the adhesive reservoir is an annular reservoir, and wherein the outer wall of the rear body is structurally configured to transmit ultraviolet electromagnetic radiation.

* * * * *